US006344796B1

(12) United States Patent
Ogilvie et al.

(10) Patent No.: US 6,344,796 B1
(45) Date of Patent: Feb. 5, 2002

(54) UNATTENDED PACKAGE DELIVERY CROSS-DOCKING APPARATUS AND METHOD

(75) Inventors: Timothy Ogilvie, Washington, DC (US); Mark Stein, Arlington, VA (US); Carter Griffin, Washington, DC (US)

(73) Assignee: Brivo Systems, Inc., Arlington, VA (US)

( * ) Notice: Subject to any disclaimer, the term of this patent is extended or adjusted under 35 U.S.C. 154(b) by 0 days.

(21) Appl. No.: 09/698,064

(22) Filed: Oct. 30, 2000

Related U.S. Application Data

(60) Provisional application No. 60/161,927, filed on Oct. 28, 1999.

(51) Int. Cl.[7] ..... G08B 13/14

(52) U.S. Cl. ..... 340/568.1; 340/543; 340/539; 340/693; 340/569; 340/571; 340/542; 340/5.2; 340/5.21; 340/5.73; 340/5.54; 340/5.23

(58) Field of Search ..... 340/568.1, 543, 340/539, 693, 569, 571, 542, 5.2, 5.21, 5.73, 5.54, 5.23

(56) References Cited

U.S. PATENT DOCUMENTS

| | | | | |
|---|---|---|---|---|
| 4,896,024 A | | 1/1990 | Morello et al. | 235/381 |
| 4,897,630 A | * | 1/1990 | Nykerk | 340/426 |
| 4,961,507 A | | 10/1990 | Higgins | 221/429 |
| 5,014,875 A | | 5/1991 | McLaughlin et al. | 221/2 |
| 5,091,713 A | | 2/1992 | Horne et al. | 240/541 |
| 5,118,175 A | * | 6/1992 | Costello | 312/242 |
| 5,153,561 A | * | 10/1992 | Johnson | 340/571 |
| 5,223,829 A | | 6/1993 | Watabe | 340/805.31 |
| 5,247,282 A | | 9/1993 | Marshall | 340/569 |
| 5,313,393 A | | 5/1994 | Varley et al. | 364/403 |
| 5,386,462 A | | 1/1995 | Schlamp | 379/106 |
| 5,482,139 A | | 1/1996 | Rivalto | 186/36 |
| 5,699,685 A | * | 12/1997 | Jahrsetz et al. | 70/264 |
| 5,774,053 A | | 6/1998 | Porter | 340/568 |

* cited by examiner

*Primary Examiner*—Jeffery Hofsass
*Assistant Examiner*—Tai T. Nguyen
(74) *Attorney, Agent, or Firm*—Baker Botts, LLP

(57) ABSTRACT

Unattended package delivery cross-docking apparatus includes a plurality of storage devices, each having a door with a lock that is locked and unlocked in response to codes. A local lock controller is associated with each of the storage devices and includes an entry device for entering an access code that unlocks the lock when it is locked and a transaction code that locks the lock when it is unlocked. A central operations controller in communication with the local lock controllers is programmed to receive the access and transaction codes entered to each local lock controller, to create an access code for the lock of each storage device upon receiving a transaction code that locks the lock, and to output a notice of the access code to be used to unlock the lock of each storage device when it is locked.

15 Claims, 4 Drawing Sheets

UNATTENDED PACKAGE DELIVERY CROSS-DOCKING APPARATUS AND METHOD

REFERENCE TO PRIOR APPLICATIONS

The present application is based on U.S Provisional Patent Application No. 60/161,927, filed Oct. 28, 1999, and entitled "Unattended Business-to-Business Cross-Docking System", which is incorporated herein by reference for all purposes.

BACKGROUND OF THE INVENTION

Transportation/distribution businesses want inexpensive cross-docking capabilities for goods with low material handling complexity, especially for small parcels. A cross-dock is a place where local shippers can exchange custody of goods with regional or national shippers to achieve better transportation economics. Attended, full-service cross-docking facilities, including large bays, material handling equipment, and other services, are generally not needed or used for the small parcel delivery business (e.g., UPS and FedEx).

Self-storage facilities, which are sometimes attended and other times unattended, are often used by small businesses to store inventory. When a small business receives goods from a vendor at a place of business, such as a home or small office, someone has to go to the storage facility and place the goods in a storage room or container. When the small business receives an order from a customer, someone has to go to the storage facility, remove the goods needed to fill the order, and go to a shipper to have the ordered goods shipped.

Businesses and individuals often want to be able to receive and to send packages through shippers without having to be present at the time of delivery or pick-up.

U.S. Pat. No. 5,744,053 (Porter, Jun. 30, 1998) describes and shows a lockable storage device for containing goods for delivery and pickup and ancillary data storage and communication apparatus that provides access to the storage device only to persons having some form of access code and notifies the owner of the device and shippers when incoming goods have been delivered to the storage device or outgoing goods have been placed in the storage device for pickup. The present invention uses lockable storage devices according to the concepts of the Porter '053 patent, which is incorporated by reference into the present specification for all purposes.

SUMMARY OF THE INVENTION

One object of the present invention is to provide a low-cost unattended cross-docking depot, which can be used by shippers, small businesses and individuals in much the same ways as previously known attended cross-docking facilities and self-storage facilities. Another object is to provide a facility and a method that can be used by businesses and individuals for receipt and storage of goods without requiring them to be present at the time of delivery. Yet another object is to provide a facility and a method that enables businesses and individuals to leave goods for pick-up by a shipper.

The foregoing objects are attained, in accordance with the present invention, by unattended package delivery cross-docking apparatus having a plurality of storage devices, each having a door with a lock that is locked and unlocked in response to codes. A local lock controller is associated with each of the storage devices and includes an input device for inputting an access code that unlocks the lock when it is locked and a transaction code that locks the lock when it is unlocked. A central operations controller in communication with the local lock controllers is programmed to receive the access and transaction codes input to each local lock controller, to create an access code for the lock of each storage device upon receiving a transaction code that locks the lock, and to output a notice of the access code to be used to unlock the lock of each storage device when it is locked.

The apparatus, according to the invention, permits regional and national/international shippers, such as UPS, USPS, DHL and FedEx, to deliver goods to consignees, which may be local shippers, businesses and individuals, who desire to receive incoming goods when they are not physically present to receive them. Similarly, local shippers, businesses and individuals can deposit outgoing goods for pick-up. Among the many benefits of the invention are the cost benefits of permitting self-service for cross-docking and related logistics operations to support package and parcel deliveries and pickups. In addition to reducing labor costs, the apparatus and method according to the invention, improves the security, traceability, and control of logistics operations, enabling highly efficient supply chain operations. The invention may be coupled with other unattended depot applications (such as business-to-consumer depot delivery/pickup applications, or business-to-business ganged bins for office delivery, each described separately below) to create a completely new node in the logistics chain that benefits many constituents.

The apparatus, preferably, includes a secure enclosure containing the plurality of storage devices, an entry door for admitting persons into the enclosure and having a lock that can be unlocked only in response to authorization codes, and an enclosure lock controller in communication with the central operations controller for receiving and storing authorization codes and including an input device for inputting by users of the apparatus of authorization codes to unlock the entry door. A secure enclosure minimizes the possibility of theft.

The central operations controller includes a memory unit for storing data specific to incoming goods including the identification of the specific storage device in which incoming goods have been placed by a shipper for pickup by a consignee and the access code, which was created by the central operations controller when the goods were placed in the storage device, that permits that storage device to be unlocked by the consignee. The central operations controller may be programmed to communicate the data specific to incoming goods to the consignee electronically via a global communications network, such as by a voice message, by fax or by E-mail.

Advantageously, the central operations controller is arranged for input and storage of data specific to incoming goods provided by a shipper prior to delivery of the incoming goods to the apparatus and to provide to the shipper a transaction code for input to a local lock controller. After the shipper places the incoming goods in a storage device, he or she inputs the transaction code on the local lock controller, thus "notifying" the central operations controller that the incoming goods are ready for pickup by the consignee. The central operations controller is arranged to retrieve and output the data specific to incoming goods provided by a shipper and to create an access code for the incoming shipment in response to the input of the transaction code on the local lock controller associated with the storage device in which the shipper has placed the incoming goods. The consignee is then notified by whatever mode of communication (e.g., telephone, fax, or e-mail) that the consignee has registered with the provider of the apparatus.

In a particular example, the central operations controller is programmed to communicate the data specific to incoming goods, the identity of the specific storage device in which those incoming goods have been placed and the access number to the consignee of such incoming goods electronically via a global communications network.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENTS

Figure 1:
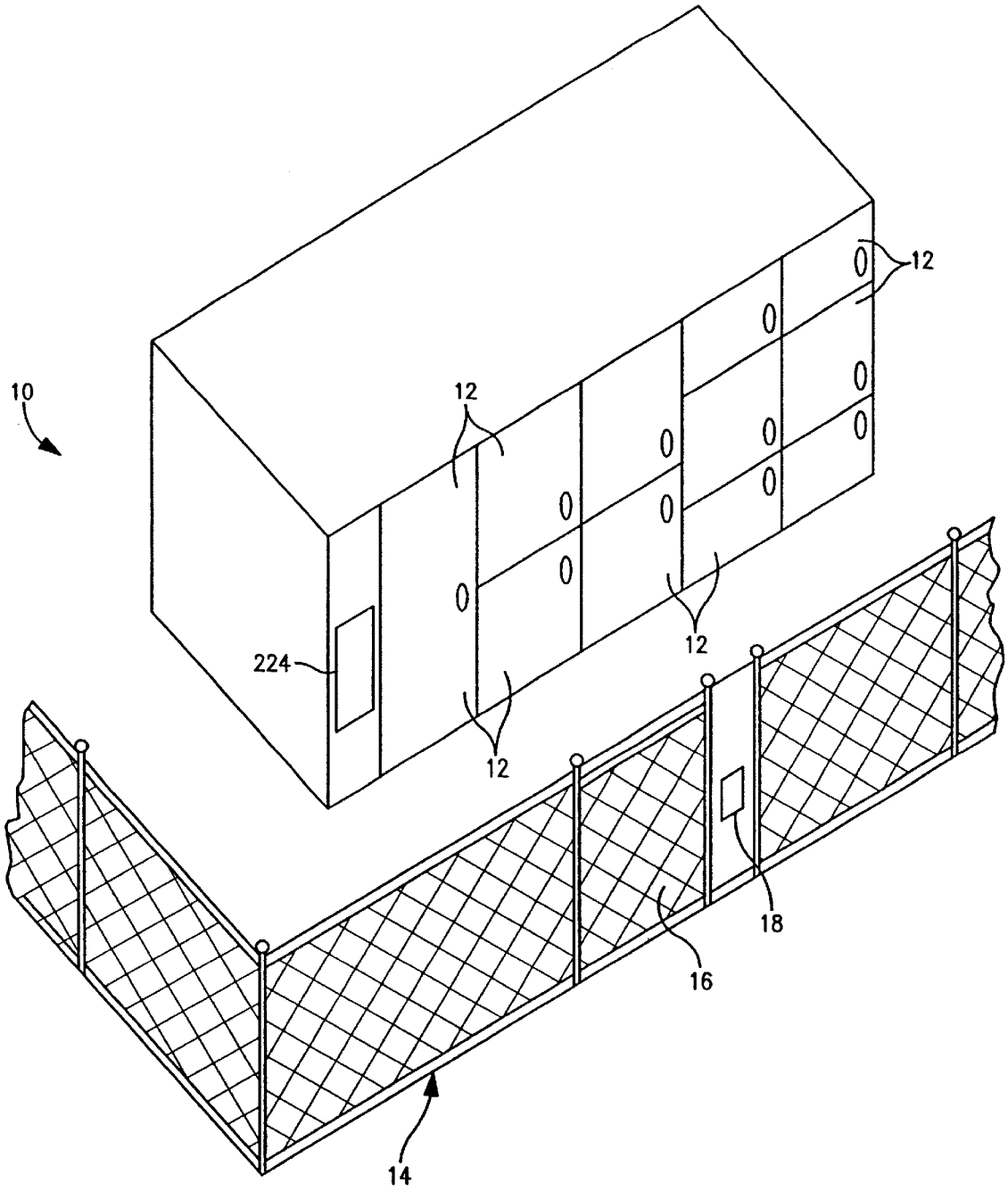
FIG. 1 is an schematic pictorial view of a cross-docking facility embodying the present invention.

Referring to FIG. 1, to enable unattended self-service, a depot 10 has multiple storage devices 12, which may be of various sizes, each with a unique locking/access system, positioned within a secure enclosure 14, such as a fence in the case of an outdoor depot. Such storage devices (or storage bins) 12 may, for example, be of the type described in U.S. Pat. No. 5,774,053 to Porter, which is referred to above, and are identified in FIGS. 3 and 4 of the drawings as "SB." The bins 12 may, of course, be located in a secure space in a building. The secure enclosure is accessed though an entry door 16, which is locked by a lock that requires an authorization code to unlock. An input device 18 enables the authorization code to be entered to unlock the lock of the door 16, as described below.

Figure 2:
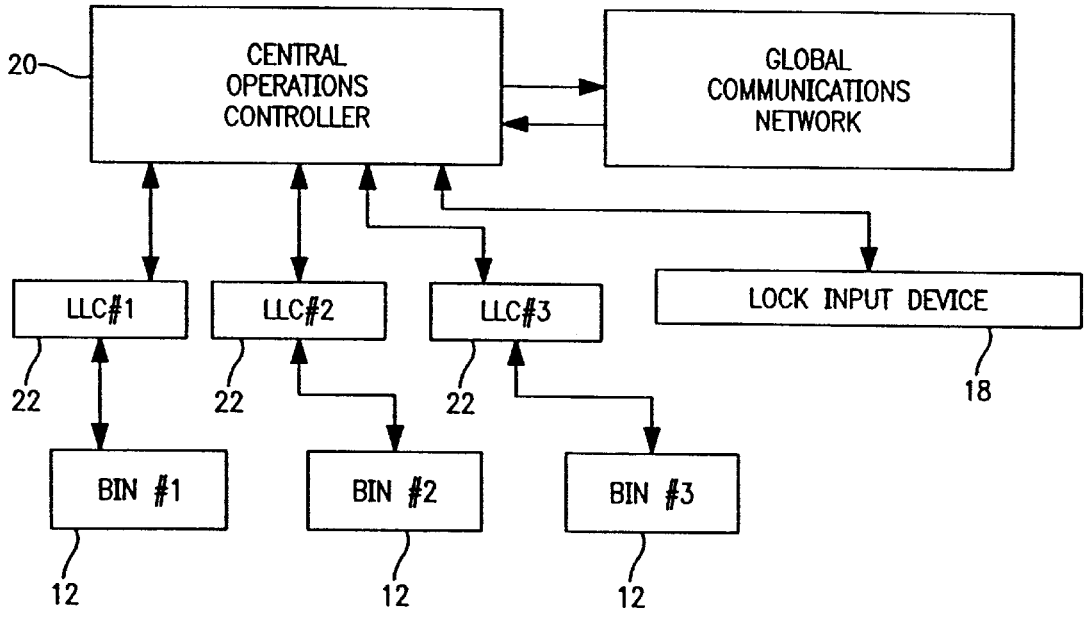
FIG. 2 is a schematic diagram of other elements of an embodiment of apparatus according to the invention.
Figure 3:
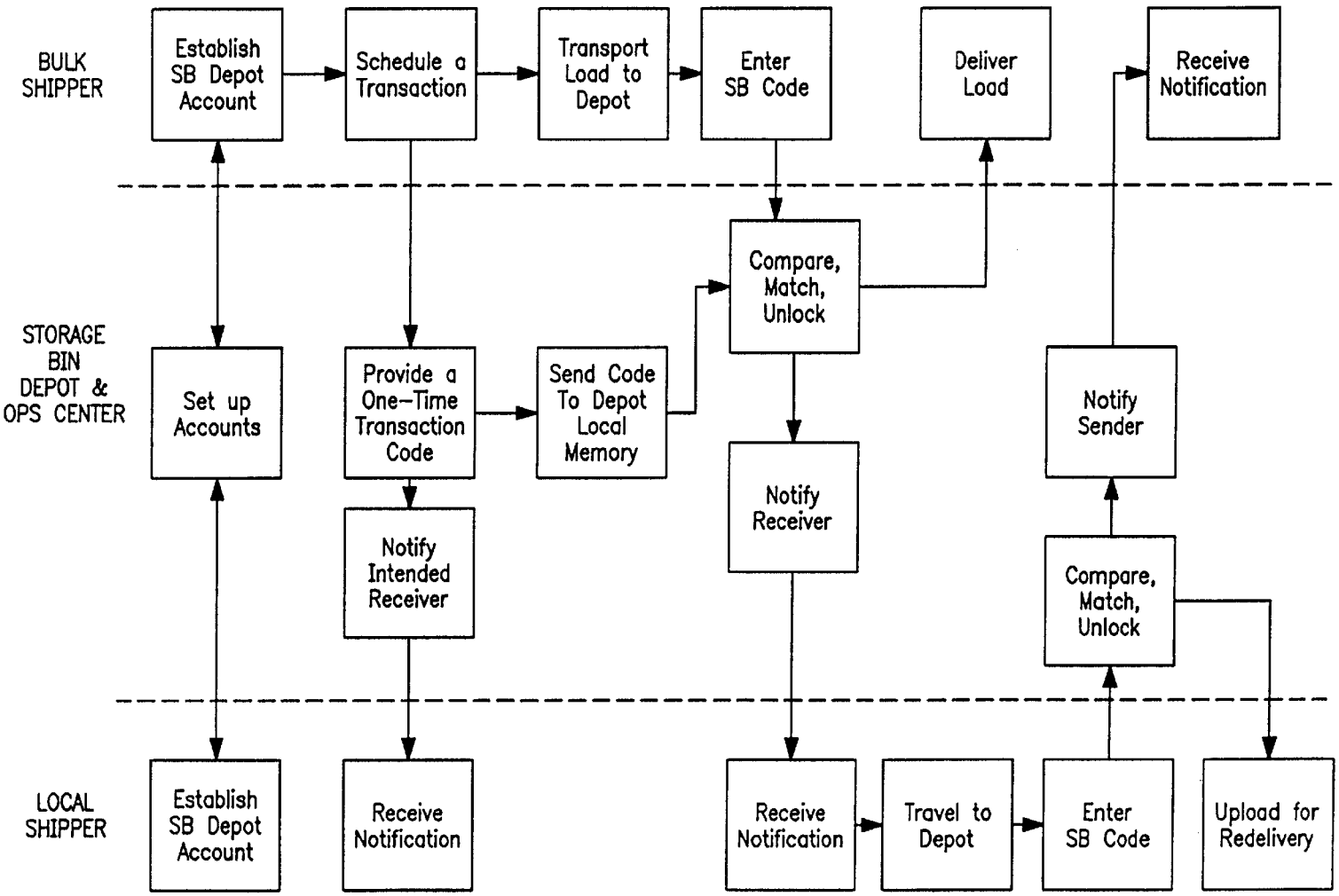
FIG. 3 is flow diagram, illustrating the steps of an embodiment of a method using the apparatus of FIGS. 1 and 2 in which a bulk shipper delivers goods to a local shipper.

Referring to FIG. 3, businesses using the cross-docking facility 10 (whether dropping off or picking up) establish accounts with the company that provides and services the depot ("the provider") prior to using the depot. A transport company carrying bulk delivery (the "bulk shipper") to, for example, the Northeast might wish to cross-dock at the unattended depot, leaving incoming items for a regional or local transport company ("local shipper") to pick up and redistribute. The inbound bulk shipper schedules the transaction on the unattended delivery system, and the provider's central operations center (("OPS"), which maintains a central operations controller 20 (FIG. 2), creates and provides to the bulk shipper an authorization code to enter on the input device 22*u* of the secure facility and to access the storage bins 12. Upon arriving at the secured cross-docking center, the bulk shipper enters the authorization code via the input device 18 of the entry gate 16 in order to gain access to the facility. The authorization code can be entered directly into a keypad at the gate to the facility. Alternatively, the authorization code could be entered using special wands or other entry access systems.

Once inside, the bulk shipper locates the specific bin or bins 12 (FIG. 1) which were assigned to them by the central operations center ("OPS" in FIGS. 3 and 4))—alternatively, the shipper could choose any free bin. Bins 12 that are empty or unassigned are unlocked. Once the bulk shipper unloads the incoming items into the selected bin or bins, they lock those bins using a pre-assigned transaction code provided to them by the central operations center. This code will usually be associated by the central operations center with all data of the transaction as the bulk shipper had arranged it, including the payload, the identity of the receiving party (the "local shipper"), storage locations, and other pertinent transaction data. The bulk shipper then departs, having completed their portion of the cross-docking transaction.

As shown in FIG. 2, each bin 12 is coupled to a local lock controller (LLC) 22, which controls the lock associated with each bin in accordance with the transaction and access codes established by the central operations controller 20 and downloaded when generated to the local lock controller. As shown in FIG. 1, the local lock controller for each bin is associated with a control unit 22U similar to an ATM kiosk. Each time that a transaction code is input on the local lock controller, which locks the lock on the associated bin, the code for the lock is reset by the central operations controller 20 to an access code that allows the lock to be opened.

The local shipper, who has previously registered with the provider of the depot 10, is informed of the exact time their goods become available for pickup and the bin or bins 12 that contain the incoming goods, because the unattended delivery system notifies them of the drop-off by the bulk shipper. This notification can be via fax, e-mail, Internet message, voice, paging device, or other communications means (see, generally, FIG. 2). The central operations controller 20 creates an access code to be used by the local shipper for access to the bins and includes it in the notice to the local shipper. The local shipper then schedules a pickup by one or more of their trucks. To gain access to the depot facility and the bins 12, the local shipper uses the access code provided in the notification message, which is supplied to the lock input device 18 for the gate 16 to the secure enclosure by the central operations controller 20 and to the local lock controller 22 associated with the appropriate bin(s). Once the pickup is made, the unattended delivery system notifies the bulk shipper, the headquarters for the local shipper, and any interested third parties (possibly the originator of the shipment, or the ultimate consignee).

The pickup can be staged to be made by multiple local shippers. For example, local shipper #1 might pick up some of the parcels left by a bulk shipper in their assigned bin. Local shipper #1 logs specific packages using a tracking system such as a bar code scanner. Once the first transaction is complete, the unattended delivery system notifies local shipper #2 that their pickup is ready. The second pickup will be enabled by a separate access code, to ensure the pickups happen in sequence.

Local shippers, which may be local shipping companies, small businesses that use the depot as a "shipping department," or individuals, can deposit outgoing goods at the depot for pickup by a bulk shipper. They gain access to the depot using a transaction code obtained by pre-arrangement with the provider of the depot, which may supplied as part of the initial registration process or established on a case-by-case basis. They load the outgoing goods in one or more bins and enter the transaction code in the local lock controller 22. The central operations controller creates an access code, inputs the access code to the lock or locks of the bin or bins and notifies the bulk shipper that goods are in specified bins for access under the access number for pickup. When the bulk shipper picks up the outgoing goods, inputting the access number triggers a notification to the local shipper that the outgoing goods have been picked up.

In a variant of the method diagrammed in FIG. 3, office buildings may want to permit unattended after-hours deliveries of packages as a convenience to the tenants and as a benefit to transport companies. This invention envisions the installation of a bank of unattended delivery bins in a secure area immediately adjacent to an office property or in a secure space set aside within the office building, in an area that may be accessed 24 hours per day. Transport or delivery companies such as United Parcel Service, Federal Express, DHL, Airborne Express, or United States Postal Service may make deliveries to, and pickups from, such ganged bins. Tenants of the building receive notification when incoming packages are available for pickup. Delivery agents receive notification when outbound items are ready for pickup, so they only need to visit the building when they are sure they have a transaction to make. In a preferred configuration, there is a single control/communications module 22U to control a number of bins (see FIG. 1).

Each tenant of the building sets up an account. The account allows each user to provide the central operations center with their notification preferences, establish billing preferences, payment information, details about multiple users, and so forth. Payment information may include credit card, debit card, electronic check, or e-wallet information. The e-wallet is designed to effect payments over the Internet via a debiting wallet. Delivery agents also need to establish an account with the provider of the depot 10.

Customers may add a permanent storage device identification number to their delivery address to be included when people send them packages, or when customers send outbound packages. When a delivery agent has a package for a tenant of a building with this ganged bin solution, they will go directly to the bank of bins and put all the packages for that tenant into one or more available bins. As they close each bin, they will enter the transaction code(s) into the keypad of the unit 22U, which locks the bin and triggers notification to the customer. The central operations center will notify the customer by his/her preferred communications method and provide them with the bin number and the access code to retrieve their packages. The code may persist for a period of time, to accommodate the possibility of making multiple trips to unload a relatively full bin.

When a customer has an outbound package, they will place it in an available bin amongst the group of ganged bins and enter their permanent storage device identification number upon closing the bin door. This locks the bin and automatically triggers an electronic communication instructing the central operations center to signal the delivery agent to make a pickup.

In another embodiment of this invention, which is essentially the same as the embodiment described above and is diagrammed in FIG. 4, a consumer may want the ability to receive packages with very flexible hours and near their home, but may not want to position a storage device adjacent to their home. This invention also addresses the possibility of deploying a bank of storage devices at some convenient location along the routes where consumers drive home. This bank of storage devices serves as a depot to receive shipments from multiple vendors and permit pickup by consumers. It has the advantage of being unattended, working much like an ATM facility.

The consumer must be a registered customer of with the central operations center. The center must have the consumer's personal contact information on file in its database, including how the consumer prefers to be contacted when they have a package. The delivery agents do not need any prior relationship with the center in order to deliver to such a consumer delivery depot.

Figure 4:
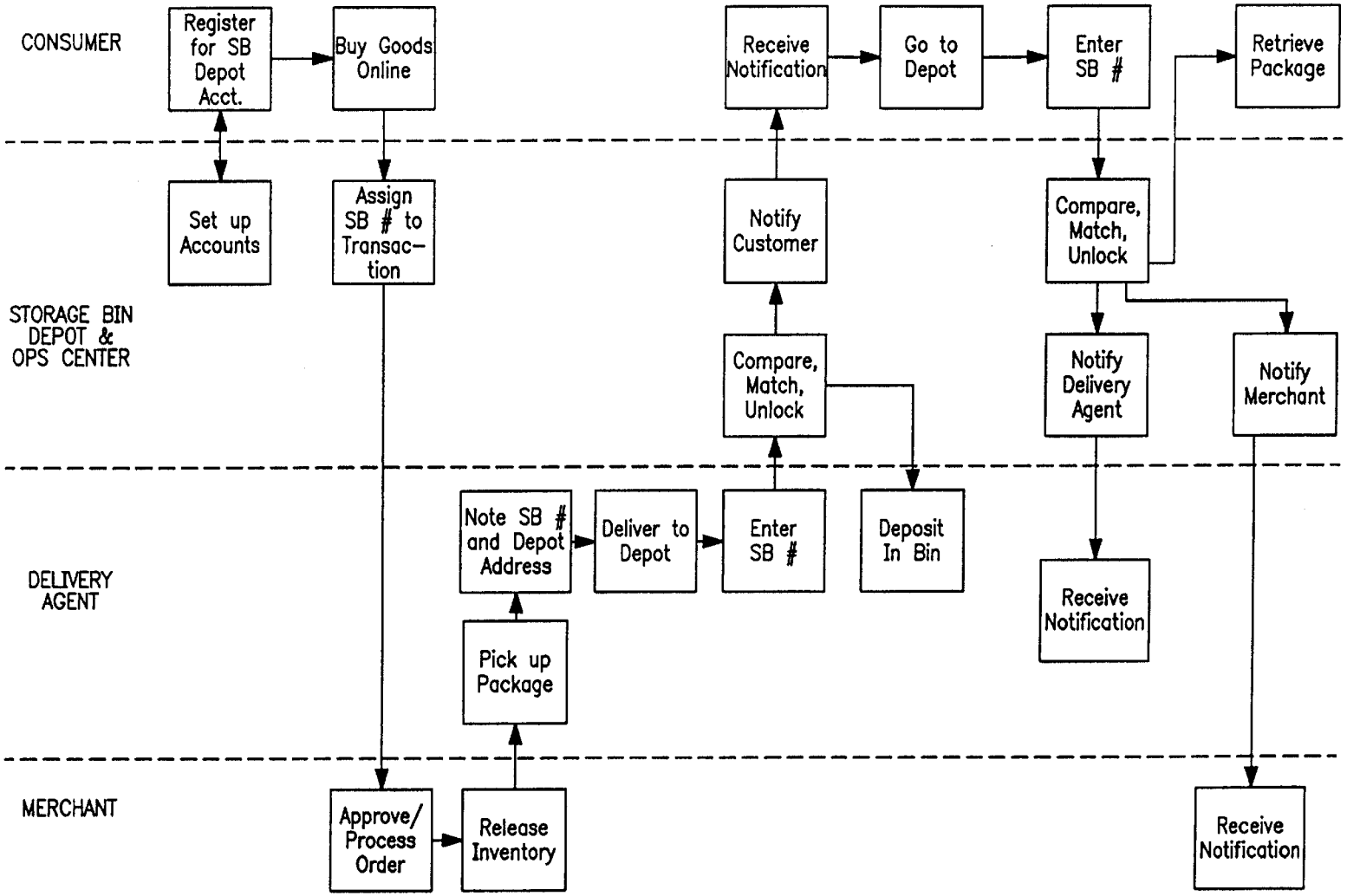
FIG. 4 is flow diagram, illustrating the steps of an embodiment of a method using the apparatus of FIGS. 1 and 2 in which a business or individual orders goods on-line (or by telephone) from a merchant for delivery through the unattended cross-docking apparatus by a delivery agent.

Referring to FIG. 4, assume the consumer orders a computer and a monitor by phone or online from "AnyCompany.com." The consumer does not want to send it to his/her home because no one will be there to receive it. The consumer does not want to send it to his/her office because the boxes will be large and heavy, and the consumer will have to transport them home. Instead, the consumer indicates a storage device identification number on the ship-to address provided to AnyCompany.com and specifies a shipper. The provider of the depot has previously established a relationship with the shipper so that when the shipper picks up the order from AnyCompany.com, it recognizes the storage device identification number on the ship-to address of the order as a depot delivery and contacts the provider's central operations center to obtain the appropriate depot address to use. The delivery agent transports the package to the depot, places it into the most convenient bin, and enters the delivery code number on the local lock controller panel 22U by an IR communications device (used by major shippers such as UPS and FedEx), a keypad, or some other means of data entry.

Once the bin is closed and a delivery code entered, the bin cannot be re-opened by the delivery agent. The central operations center recognizes the package as one that was expected at the depot, and it matches the package code to the consumer order based on the delivery code supplied by the shipper. Based on the consumer's notification preferences, the central operations center transmits notification to the customer that their "AnyCompany" computer and monitor have arrived at the depot and are located in bin x, which may be accessed using access code y. The consumer may use the code to enter the secure depot facility and to access the bin. The consumer may, alternatively, enter the facility using an assigned customer code or using any suitable entry device. The customer uses the access code assigned to the transaction to open the bin in which the delivery agent has left the computer and monitor. Once the bin is opened, the code perishes and the bin will not be re-locked—the bin is now available for another delivery of incoming goods or deposit of outgoing goods for pick-up.

Consumers may also use the depot to ship goods without going to the Post Office or a package shipper. In a preferred embodiment, they will first use the central operations center website to create a package delivery code number and bar code label, which they then attach to the package. Again, the package delivery code will permit the customer to gain access to the secure depot facility, and they may use any available bin. Upon depositing the outbound package into the bin, the customer closes the bin and enters the delivery code number, locking the bin. The central operations center receives the signal that the outbound shipment is ready for pickup, and the central operations center then signals the delivery agent to come make a pickup, providing them with a bin location and a perishable transaction code.

What is claimed is:

1. An unattended package delivery cross-docking apparatus, comprising a plurality of storage devices, each having a door with a lock that is locked and unlocked in response to codes, a local lock controller associated with each of the storage devices and including an input device for inputting an access code that unlocks the lock when it is locked and a transaction code that locks the lock when it is unlocked, and a central operations controller in communication with the local lock controllers and programmed to receive the access and transaction codes input to each local lock controller, to create an access code for the lock of each storage device upon receiving a transaction code that locks the lock, and to output a notice of the access code to be used to unlock the lock of each storage device when it is locked.

2. The apparatus of claim 1, and further comprising a secure enclosure containing the plurality of storage devices, an entry door for admitting persons into the enclosure and having a lock that can be unlocked only in response to authorization codes, and an enclosure lock controller in communication with the central operations controller for receiving and storing authorization codes and including an input device for inputting by users of the apparatus of authorization codes to unlock the entry door.

3. The apparatus of claim 1, wherein the central operations controller includes a memory unit for storing data including transaction codes of users who register in advance to pick up incoming goods from and deposit outgoing goods in the storage devices of the apparatus.

4. The apparatus of claim 1, wherein the central operations controller includes a memory unit for storing data specific to incoming goods including the identification of the specific storage device in which incoming goods have been placed by a shipper for pickup by a consignee and the access code that permits that storage device to be unlocked by the consignee.

5. The apparatus of claim 4, wherein the central operations controller is programmed to communicate the data specific to incoming goods to the consignee electronically via a global communications network.

6. The apparatus of claim 4, wherein the central operations controller is arranged for input and storage of data specific to incoming goods provided by a shipper prior to delivery of the incoming goods to the apparatus and to provide to the shipper a transaction code for input to a local lock controller.

7. The apparatus of claim 6, wherein the central operations controller is arranged to retrieve and output the data specific to incoming goods provided by a shipper and to create an access code for the incoming shipment in response to the input of the transaction code on the local lock controller associated with the storage device in which the shipper has placed the incoming goods.

8. The apparatus of claim 7, wherein the central operations controller is programmed to communicate the data specific to incoming goods, the identity of the specific storage device in which those incoming goods have been placed and the access number to the consignee of such incoming goods electronically via a global communications network.

9. A method for unattended package delivery comprising the steps of providing cross-docking apparatus having a plurality of storage devices, each having a door with a lock that is locked and unlocked in response to codes, a local lock controller associated with each of the storage devices and including an input device for inputting an access code that unlocks the lock when it is locked and a transaction code that locks the lock when it is unlocked, and a central operations controller in communication with the local lock controllers and programmed to receive the access and transaction codes input to each local lock controller, to create an access code for the lock of each storage device upon receiving a transaction code that locks the lock, and to output a notice of the access code to be used to unlock the lock of each storage device when it is locked, and inputting and storing in the central operations controller data including transaction codes and communication information for users who register in advance to pick up incoming goods from and deposit outgoing goods in the storage devices of the apparatus.

10. The method of claim 9, and further comprising the steps carried out in response to the inputting of a transaction code on a local lock controller by a shipper of storing in the central operations controller data specific to incoming goods including the identification of the specific storage device in which incoming goods have been placed by a shipper for pickup by a registered user and creating an access code that permits that storage device to be unlocked by the registered user by inputting the access code on the local lock controller.

11. The method of claim 10, and further comprising the steps of communicating the data specific to incoming goods to the registered user.

12. The method of claim 11, and further comprising the steps of communicating the data specific to incoming goods to the registered user electronically via a global communications network.

13. The method of claim 10, and further comprising the step of inputting and storing in the central operations controller data specific to incoming goods provided by a shipper prior to delivery of the incoming goods to the apparatus and creating and communicating to the shipper a transaction code for inputting to the local lock controller upon deposit by the shipper of the incoming goods in a storage device.

14. The method of claim 13, and further comprising the steps carried out in response to the input by the shipper of the transaction code of creating an access code and communicating to the registered user the data specific to incoming goods, the identification of the storage device in which such goods have been placed and the access code for unlocking the storage device.

15. The method of claim 14, wherein the data specific to incoming goods, the identification of the storage device in which such goods have been placed and the access code are communicated to the consignee of such incoming goods electronically via a global communications network.

* * * * *